US005998346A

United States Patent [19]

Welch et al.

[11] Patent Number: 5,998,346

[45] **Date of Patent: *Dec. 7, 1999**

[54] NON-PHOSPHATE MACHINE DISHWASHING COMPOSITIONS CONTAINING COPOLYMERS OF ALKYLENE OXIDE ADDUCTS OF ALLYL ALCOHOL AND ACRYLIC ACID

[75] Inventors: Michael C. Welch, Woodhaven; Kenneth L. Zack; Glenis Roberts, both of Wyandotte, all of Mich.

[73] Assignee: BASF Corporation, Mt. Olive, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/968,853

[22] Filed: Nov. 5, 1997

Related U.S. Application Data

[63] Continuation of application No. 08/568,087, Dec. 6, 1995, abandoned.

[51] Int. Cl.[6] ..... C11D 7/54; C11D 3/37

[52] U.S. Cl. ..... 510/230; 510/475; 510/476; 510/477; 510/379; 510/367

[58] Field of Search ..... 510/220, 226, 510/229, 230, 475, 476, 477, 522

[56] References Cited

U.S. PATENT DOCUMENTS

| | | | |
|---|---|---|---|
| 3,627,686 | 12/1971 | Sabatelli | 252/527 |
| 5,041,232 | 8/1991 | Batal et al. . | |
| 5,045,223 | 9/1991 | Batal et al. . | |
| 5,152,911 | 10/1992 | Savio | 252/95 |
| 5,240,632 | 8/1993 | Brumbaugh | 252/95 |
| 5,279,756 | 1/1994 | Savio et al. . | |
| 5,281,351 | 1/1994 | Romeo | 252/99 |
| 5,308,532 | 5/1994 | Adler | 252/DIG. 2 |
| 5,399,285 | 3/1995 | Kanluen | 252/156 |
| 5,480,576 | 1/1996 | Gary | 134/25.2 |
| 5,534,183 | 7/1996 | Gopalkrishnan | 510/434 |
| 5,534,198 | 7/1996 | Masters | 510/182 |
| 5,536,440 | 7/1996 | Gopalkrishnan | 510/417 |
| 5,595,968 | 1/1997 | Gopalkrishnan et al. . | |
| 5,618,782 | 4/1997 | Gopalkrishnan et al. | 510/418 |

FOREIGN PATENT DOCUMENTS

| | | | |
|---|---|---|---|
| 58-5398 | 1/1983 | Japan | C11D 3/37 |
| 2 225 589 | 6/1990 | United Kingdom . | |

*Primary Examiner*—Margaret Einsmann
*Attorney, Agent, or Firm*—Nixon & Vanderhye P.C.

[57] ABSTRACT

An improved powdered non-phosphate machine dishwashing composition comprising a blend of nonionic surfactants, builders, chlorine or non-chlorine bleach, bleach activators, enzymes and copolymers of alkylene oxides adducts of allyl alcohol and acrylic acid useful in reducing spotting and filming of dishware.

21 Claims, No Drawings

NON-PHOSPHATE MACHINE DISHWASHING COMPOSITIONS CONTAINING COPOLYMERS OF ALKYLENE OXIDE ADDUCTS OF ALLYL ALCOHOL AND ACRYLIC ACID

This application is a continuation, of application No. 08/568,087, filed Dec. 6, 1995, now abandoned.

FIELD OF THE INVENTION

This invention relates to improved powdered, non-phosphate dishwashing compositions containing certain copolymers of alkylene oxide adducts of allyl alcohol and acrylic acid.

BACKGROUND OF THE INVENTION

Machine dishwashing formulations generally contain inorganic phosphate salts as builders to sequester calcium and magnesium ions in water to minimize filming of dishware.

Because of environmental considerations associated with the use of phosphates as builders, formulations have been developed without phosphate and chlorine compounds. Non-phosphate formulations generally contain salts of low molecular weight organic acids, such as sodium citrate, as builders. Since citrate is not as effective a builder as phosphate, other additives, known in the art, such as polymers of acrylic acid are used to minimize the increase in spotting and filming that occurs with non-phosphate formulations.

The use of detergent compositions containing copolymers of the alkylene oxide adducts of allyl alcohol and acrylic acid is described in the art.

GB 2,225,589A, filed Dec. 1, 1989 (assigned to Kao), discloses:

An abrasive liquid cleanser composition comprising:

(a) a higher fatty acid alkanol amide or alkylene oxide adduct;

(b) an alkali metal salt of an alkyl benzene sulfonic acid;

(c) 3 to 70% of a water insoluble abrasive;

(d) 0.1 to 5% by weight of one or more of water soluble polymers with a molecular weight of from 200 to 10,000 such as a polyacrylic acid salt, a polymaleic acid salt, a salt of copolymer of acrylic acid and maleic acid, a salt of copolymer of isobutylene and maleic acid, a salt of copolymer of styrene and maleic acid, a salt of copolymer of allyl alcohol and maleic acid and a salt of copolymer of disobutylene and maleic acid.

U.S. Pat. No. 5,308,532, issued May 3, 1994 (assigned to Rohm and Haas), discloses: water soluble terpolymers, useful in automatic dishwashing detergent formulations, containing:

(a) from about 92 to about 30 percent by weight of one or more $C_3$–$C_6$ monoethylenically unsaturated carboxylic acids, such as acrylic acid;

(b) from about 5 to about 50 percent by weight of one or more aminoacryloyl derivatives such as dimethylamino propylacrylamide (DMAPA); and (c) from about 3 to about 25 percent by weight of one or more monoethylenically unsaturated monomers such as acrylamide, methacrylamide and allyl alcohol polymerizable with (a) and (b).

However, none of these references disclose the use of copolymers of the alkylene oxide adducts of allyl alcohol and acrylic acid in nonionic surfactant containing, non-phosphate automatic dishwashing compositions.

Further, the presently available non-phosphate formulations, while environmentally sound, are not as effective in preventing spotting and filming.

It has now been surprisingly discovered that the addition of certain copolymers of the alkylene oxide adducts of allyl alcohol and acrylic acid dramatically minimizes the spotting and filming of non-phosphate machine dishwashing compositions.

SUMMARY

The present invention relates to improved non-phosphate, machine dishwashing compositions comprising a blend of nonionic surfactants, non-phosphate builders, chlorine or non-chlorine bleaches, bleach precursors, enzymes and copolymers of alkylene oxide adducts of allyl alcohol and acrylic acid having at least one of the following formulas:

Formula I

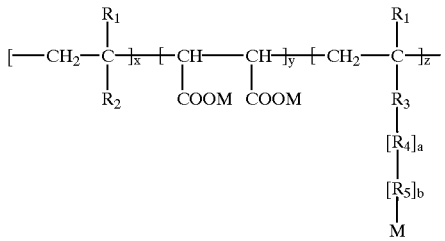

or

Formula II

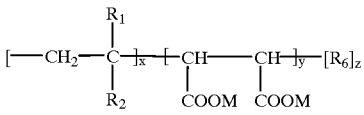

wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$ = H or $CH_3$;

$R_2$ = COOM, $OCH_3$, $SO_3M$, O—CO—$CH_3$, CO—$NH_2$;

$R_3$ = $CH_2$—O—, $CH_2$—N—, COO—, —O—, $CH_2$—O—$CH_2$—CH(O)—O—, CO—NH—;

$R_4$ = $C_3$ to $C_4$ alkyleneoxy group;

$R_5$ = —$CH_2$—$CH_2$—O;

$R_6$ = 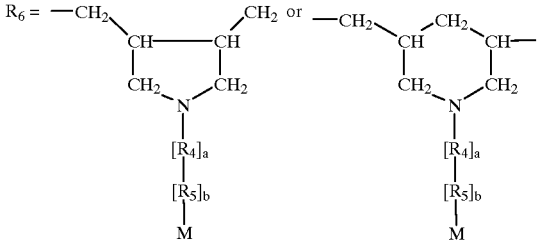

or

-continued

Formula III

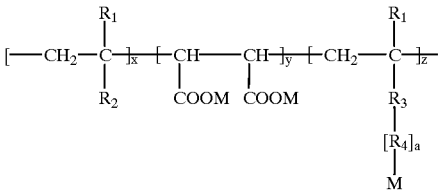

or

Formula IV

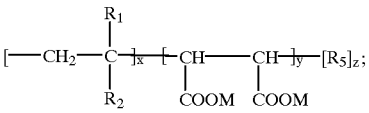

wherein x, y and z are integers, (x+y):z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$ = H or $CH_3$ $R_2$ = COOM, $OCH_3$, $SO_3M$, O—CO—$CH_3$, CO—$NH_2$ $R_3$ = $CH_2$—O—, $CH_2$—N—, COO—, —O—, $CH_2$—O—$CH_2$—CH(O)—O—, CO—NH—

$R_4$ = —$CH_2$—$CH_2$—O

Where $R_5$ =

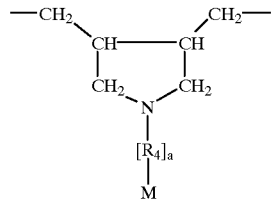

or

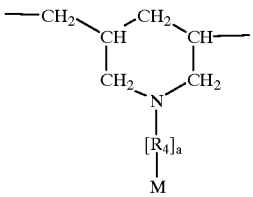

DETAILED DESCRIPTION

The compositions of the present invention are non-phosphate, machine dishwashing compositions comprising a blend of nonionic surfactants, builders, chlorine or non-chlorine bleaches, bleach precursors, bleach activators, enzymes and copolymers of alkylene oxide adducts of allyl alcohol and acrylic acid having at least one of the following formulas:

Formula I

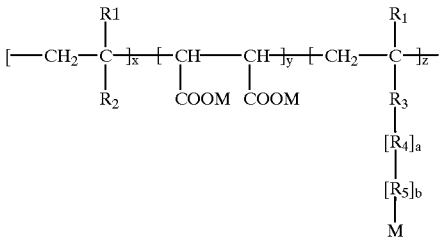

Formula II

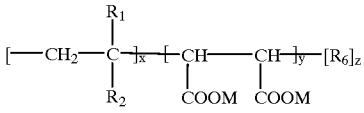

wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$ = H or $CH_3$;

$R_2$ = COOM, $OCH_3$, $SO_3M$, O—CO—$CH_3$, CO—$NH_2$;

$R_3$ = $CH_2$—O—, $CH_2$—N—, COO—, —O—, $CH_2$—O—$CH_2$—CH(O)—O—, CO—NH—;

$R_4$ = $C_3$ to $C_4$ alkyleneoxy group;

$R_5$ = —$CH_2$—$CH_2$—O;

$R_6$ =

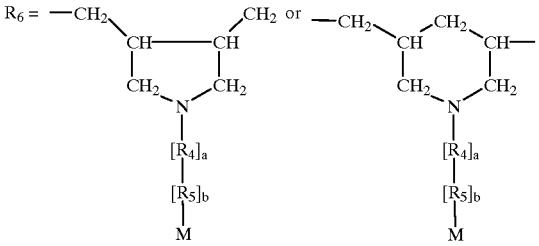

or

Formula III

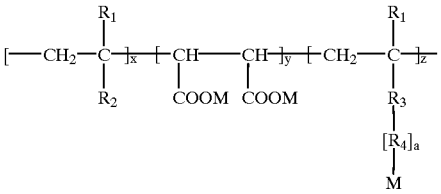

or

Formula IV

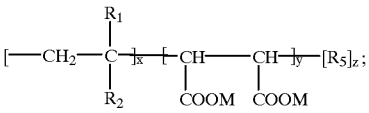

wherein x, y and z are integers, (x+y):z is from about 5:1 to 1000:1, and y can be any value ranging from zero up to the value of X; M is an alkali metal or hydrogen; a is an integer from about 3 to about 680; and the hydrophilic and oxyethylated monomers may be in random order;

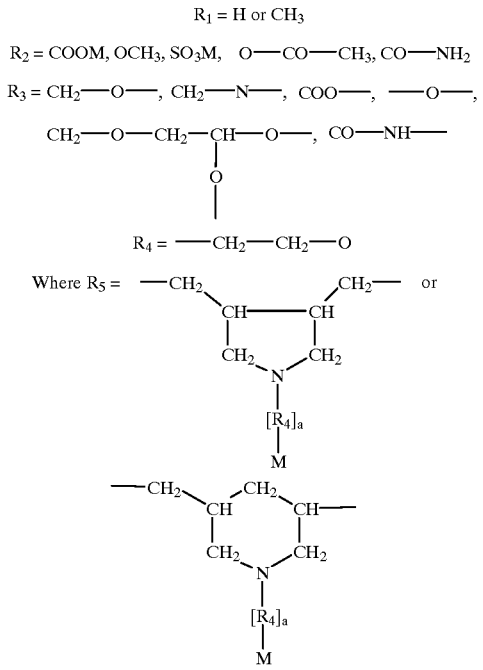

NONIONIC SURFACTANTS

The dishwashing compositions of the present invention contain nonionic surfactants at levels of 0 to 15% by weight, preferably 0.1 to 10% by weight; most preferably 1 to 6% by weight. Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxyethylene or polyoxypropylene condensates of aliphatic carboxylic acids, whether linear or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow fatty acids (derived from tallow-class fats) which contain an average of about 18 carbon atoms, palmitic acid, myristic acid, stearic acid and lauric acid.

(b) polyoxyalkylene (polyoxyethylene or polyoxypropylene) condensates of aliphatic alcohols, whether linear- or branched- chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. INDUSTROL® DW5 surfactant is a preferred condensate of an aliphatic alcohol type surfactant. INDUSTROL® DW5 surfactant is available from BASF Corporation, Mt. Olive, N.J.

(c) polyoxyalkylene (polyoxyethylene or polyoxypropylene) condensates of alkyl phenols, whether linear- or branched- chain and unsaturated or saturated, containing from about 6 to about 12 carbon atoms and incorporating from about 5 to about 25 moles of ethylene oxide or propylene oxide.

(d) Particularly preferred nonionic surfactants are selected polyalkylene oxide block copolymers. This class can include polyethoxylated polypropoxylated propylene glycol sold under the tradename "PLURONIC®" made by BASF Corporation, Mt. Olive, N.J., or polypropoxylated-polyethoxylated ethylene glycol sold under the tradename "PLURONIC-R®" made by the BASF Corporation, Mt. Olive, N.J. The first group of compounds are formed by condensing ethylene oxide with a hydrophobic base formed by the condensation of propylene oxide with propylene glycol (see U.S. Pat. No. 2,674,619). The hydrophobic portion of the molecule which, of course, exhibits water insolubility, has a molecular weight from about 1500 to 1800. The addition of the polyoxyethylene radicals to this hydrophobic portion tends to increase the water solubility of the molecule as a whole and the liquid character of the product is retained up to the point where the polyoxyethylene content is about 50 percent of the total weight of the condensation product. The latter series of compounds called "PLURONIC-R®" are formed by condensing propylene oxide with the polyethoxylated ethylene glycol condensate. This series of compounds is characterized by having an average molecular weight of about between 2000 and 9000 consisting of, by weight, from about 10 to 80 percent polyoxyethylene, and a polyoxypropylene portion having a molecular weight between about 1000 and 3100.

U.S. Pat. Nos. 4,366,326; 4,624,803; 4,280,919; 4,340,766; 3,956,401; 5,200,236; 5,425,894; 5,294,365; incorporated by reference herein, describe in detail nonionic surfactants useful in the practice of this invention.

Finally, *Surfactant Science Series,* edited by Martin J. Schick, NonIonic Surfactants, Vols. 19 and 23 provide detailed description of nonionic surfactants and are incorporated by reference herein.

ANTIFOAMERS

The compositions of the present invention may contain anti-foaming agents. Preferred anti-foaming agents are silicone anti-foaming agents used at a level of 0.2–1.0% weight percent. These are alkylated polysiloxanes and include polydimethyl siloxanes, polydiethyl siloxanes, polydibutyl siloxanes, phenyl methyl siloxanes, diethylsilanated silica. Other suitable anti-foaming agents are sodium stearate used at a concentration level of about 0.5 to 1.0% by weight, monostearyl acid phosphate used at a concentration level of about 0 to about 1.5% by weight, more preferably about 0.1 to about 1.0% by weight.

NON-PHOSPHATE BUILDERS

The dishwashing compositions of the present invention also contain approximately 2–40% by weight, preferably 4–40% by weight, more preferably 5–30% by weight, of non-phosphate builders such as, but not limited to various water-soluble, alkali metal, ammonium or substituted ammonium carbonates, and silicates. Preferred are the alkali metal carbonates, especially the sodium salts.

Specific examples of nonphosphorous, inorganic builders are sodium and potassium carbonate, bicarbonate, sesquicarbonate, tetraborate decahydrate, and silicate.

Water-soluble, non-phosphate organic builders useful herein also include non-polymeric polycarboxylates. Examples of non-polymeric polycarboxylate builders are the sodium, potassium, lithium, ammonium and substituted ammonium salts of ethylenediametetraacetic acid, nitrilotriacetic acid, oxydisuccinic acid, mellitic acid, benzene polycarboxylic acids, citric acid, and methyl glycine diacetic acid ("MGDA").

Other useful builders are sodium and potassium carboxymethyloxymalonate, carboxymethyloxysuccinate, cis-cyclo-hexanehexacarboxylate, cis-cyclopentanetetracarboxylate, and phloroglucinol trisulfonate.

Additional suitable non-polymeric polycarboxylates are the polyacetyl carboxylates described in U.S. Pat. No. 4,144,226, issued Mar. 13, 1979 to Crutchfield, et al, and U.S. Pat. No. 4,246,495 issued Mar. 27, 1979 to Crutchfield, et al, both incorporated herein by reference.

Further, other detergency builder materials useful herein are the "seeded builder" compositions disclosed in Belgian Patent No. 798,856, issued Oct. 29, 1973, incorporated herein by reference. Specific examples of such seeded builder mixtures are: 3.1 wt. mixtures of sodium carbonate and calcium carbonate having 5 micron particle diameter, 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 calcium hydroxide having a particle diameter of 0.01 micron and a 3:3:1 wt. mixture of sodium carbonate, sodium aluminate and calcium oxide having particle diameter of 5 microns.

Complete descriptions of useful non-phosphate builders useful in the practice of this invention, are described in EP 0,358,474B, U.S. Pat. No. 5,049,303; EP 0 358,472 A, incorporated by reference herein.

CHLORINE BLEACH COMPOUNDS

The compositions of the present invention may also contain chlorine bleach compounds, such as but not limited to, N-chloro imides such as trichloroisocyanuric, dichloroisocyanuric acids, and salts thereof with water-solubilizing cations such as potassium and sodium, hydantoin compounds such as 1,3-dichloro-5,5-dimethyl-hydantoin are also quite suitable. Dry, particulate, water-soluble anhydrous inorganic salts are likewise suitable for use herein such as lithium, sodium or calcium hypochlorite and hypobromite. Chlorinated trisodium phosphate is also useful in the practice of the present invention. Chloroisocyanurates are, however, the preferred bleaching agents. Said chlorine bleach compounds are present at a level of 0.5 to 10% by weight; preferably 0.5 to 5% by weight; more preferably 0.5 to 3% by weight.

NON-CHLORINE BLEACH COMPOUNDS AND BLEACH PRECURSORS

The compositions of the present invention may also contain certain non-chlorine bleach compounds such as, but not limited to, organic peroxy acids and diacyl peroxides. Said non-chlorine bleach compounds are present at a level of 0 to 20% by weight, preferably from 5 to 15% by weight, more preferably from 6 to 10% by weight. The peroxy acids usable in the present invention are solid compounds and substantially stable in the temperature range of about 40° C. to about 50° C.

Typical monoperoxy acids useful herein include alkylperoxy acids and arylperoxy acids such as:

(i) peroxybenzoic acid and ring-substituted peroxybenzoic acids, e.g. peroxy-alpha-naphthoic acid, and magnesium monoterphtalate.

(ii) aliphatic and substituted aliphatic monoperoxy acids, e.g. peroxylauric acid, peroxystearic acid and 6-(N-phtyalimido) peroxyhexanoic acid. Typical diperoxy acids useful herein include alkyl diperoxy acids and aryldiperoxy acids, such as:

(iii) 1,12-diperoxydodecanedoic acid (iv) 1,9-diperoxyazelaic acid (v) diperoxybrassylic acid; diperoxysebacic acid and diperoxysiophthalic acid (vi) 2-decyldiperoxybutane-1,4-dioic acid.

A typical diacylperoxide is dibenzoylperoxide.

Inorganic peroxygen compounds may also be suitable. Examples of these materials are salts of monopersulfate, perborate monohydrate, perborate tetrahydrate and percarbonate.

Examples of suitable chlorine-free oxygen donating bleaches also include perhydrates and peroxy compounds, as well as mixtures thereof. Perhydrates preferably include alkali metal compounds of perborates in the form of tetra- or monohydrates, perborax, percarbonates, persilicates, citrate perhydrates as well as perhydrates of urea and melamine compounds. Furthermore, acidic persalts, such as persulphates (e.g. caroates), perbenzoates, and peroxycarboxylic acids, such as peroxyphthalate, magnesium monoperoxyphthalic acid, diperoxyphthalic acid, 2-oxtyl-diperoxysuccinic acid, diperoxydodecane dicarboxylic acid, diperoxyazelaic acid midoperoxycarboxylic acid, as well as salts and mixtures thereof.

Particularly preferred bleaches are sodium percarbonate and sodium perborate.

PEROXYGEN BLEACH PRECURSORS

Peroxygen bleach precursors are compounds which react in the bleaching solution with hydrogen peroxide from an inorganic peroxygen source to generate an organic peroxy acid. They are also susceptible to hydrolysis and cannot normally be formulated directly into aqueous cleaning compositions. Precursors would be incorporated into products along with a source of hydrogen peroxide, which also could optionally be encapsulated according to the present invention. Bleach precursors are present at a level of 0 to 7% by weight, preferably 1 to 5% by weight; more preferably 3 to 5% by weight.

Precursors for peroxy bleach compounds have been amply described in the literature, including in British Nos. 836,988; 855,735; 907,358; 907,950; 1,003,310 and 1,246,339; U.S. Pat. Nos. 3,332,882 and 4,128,494; Canadian No. 844,481 and South African No. 68/6,344.

Typical examples of precursors are polyacrylated alkylene diamines, such as N,N,N,N,-tetracetylethylene diamine (TAED) and N,N,N',N'-tetracetylmethylene diamine (TAMD); acrylated glycolurils, such as tetracetylglycoluril (TAGU); triacetylcyanurate, sodium sulphophenyl ethyl carbonic acid ester, sodium acetyloxybenzene sulfonate (SABS), sodium nonanoyloxbenzene sulfonate (SNOBS) and choline sulophenyl carbonate. TAED is a preferred bleach precursor.

Peroxybenzoic acid precursors are known in the art, e.g. from GB-A-836988. Examples thereof are phenylbenzoate;

phenyl p-nitrobenzoate; o-nitrophenyl benzoate; o-carboxyphenyl benzoate; p-bromobenyl benzoate; sodium or potassium benzoyloxybenzensulfonate; and benzoic anhydride.

Other suitable precursors are described in U.S. Pat. Nos. 4,711,748, 5,045,223 (describing N-sulfonyloxyaziridine compounds) and 5,041,232 (describing sulfonimine compounds) herein incorporated by reference. The activators may be admixed with, or absorbed upon, other compatible ingredients.

Suitable bleach precursors are also described in U.S. Pat. Nos. 5,200,236: 5,151,212 and 4,619,779, incorporated by reference herein.

ENZYMES

The compositions of the present invention may also contain enzymes, such as but not limited to, lipases, amylases and proteases. Proteases such as Purafect Oxam®, Maxamill®, Purafect®, Purafect OXP®, Maxacal®, Maxapem®, Maxatase® are available from Genencor; amylases such as Termamyl® and Lumafast® are also available from Genencor; and proteases such as Alcalase®, Savinase® and Esperase® are available from Novo Industries A/S. Proteases are present at a level of 0.5 to 10% by weight; preferably 0.7 to 9% by weight; most preferably 0.8 to 8% by weight; amylases are present at a level of 0.3 to 10% by weight, preferably 0.4 to 9% by weight; most preferably 0.5 to 8% by weight; lipases are present at a level of 0 to 8% by weight.

Further, U.S. Pat. Nos. 5,173,207 and 5,240,633 describe enzymes useful in the practice of this invention and are incorporated by reference herein.

FILLERS

An inert particulate filler material which is water-soluble may also be present in cleaning compositions in powder form. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration amy range from 0% to 60%, preferably from about 10% to about 30% by weight of the cleaning composition.

OPTIONAL INGREDIENTS

Additionally, one skilled in the art understands that small amounts of perfumes, colorants, and antibacterial agents may be added to the dishwashing detergent compositions of the present invention.

CO-POLYMERS OF ALKYLENE OXIDE ADDUCTS OF ALLYL ALCOHOL AND ACRYLIC ACID

Finally, the dishwashing compositions of the present invention contain copolymers of alkylene oxide adducts of allyl alcohol and acrylic acid having at least one of the following four formulas (I, II, III or IV):

Formula I

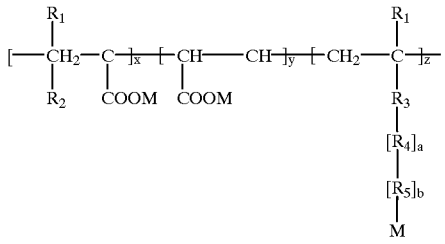

or

Formula II

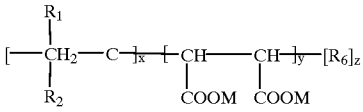

wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$ = H or $CH_3$;

$R_2$ = COOM, $OCH_3$, $SO_3M$, O—CO—$CH_3$, CO—$NH_2$;

$R_3$ = $CH_2$—O—, $CH_2$—N—, COO—, —O—, $CH_2$—O—$CH_2$—CH(O)—O—, CO—NH— ;

$R_4$ = $C_3$ to $C_4$ alkyleneoxy group;

$R_5$ = —$CH_2$—$CH_2$—O ;

$R_6$ =

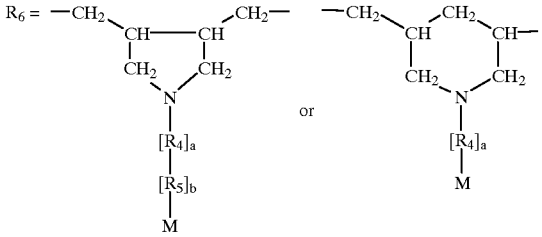

or mixtures of both;

The hydrophilic copolymer of the present invention is prepared by copolymerizing two monomers, an unsaturated hydrophilic monomer is copolymerized with an oxyalkylated monomer. These monomers may be randomly distributed within the polymer backbone.

Preferably, the unsaturated hydrophilic monomer component in formula I or II is acrylic acid.

Preferably, the oxyalkylated monomer component is a propylene oxide and ethylene oxide adduct of allyl alcohol having a molecular weight of about 3800. A preferred hydrophilic copolymer results from the polymerization of the acrylic acid monomer with the propylene oxide and ethylene oxide adduct of allyl alcohol, i.e., a copolymer of Formula I, where $R_1$=H, $R_2$=COOM, M=sodium, $R_3$=$CH_2$—O, and y=0; the value of a:b is preferably 1:5. or Formula III

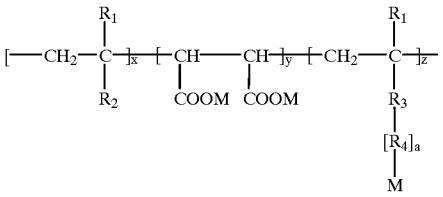

or

Formula IV

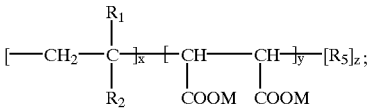

wherein x, y and z are integers, (x+y):z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$ = H or $CH_3$ $R_2$ = COOM, $OCH_3$, $SO_3M$, O—CO—$CH_3$, CO—$NH_2$ $R_3$ = $CH_2$—O—, $CH_2$—N—, COO—, —O—, $CH_2$—O—$CH_2$—CH(O)—O—, CO—NH—

$R_4$ = —$CH_2$—$CH_2$—O

Where $R_5$ = 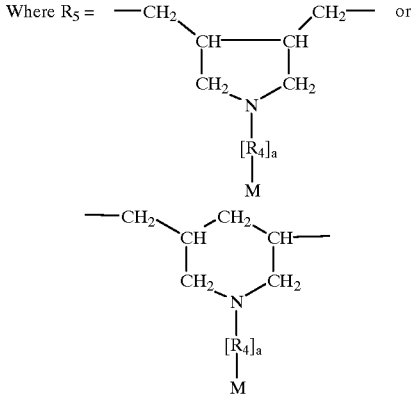 or or mixtures of both.

The hydrophilic copolymer of the present invention is prepared by copolymerizing two monomers, an unsaturated hydrophilic monomer is copolymerized with an oxyethylated monomer. These monomers may be randomly distributed within the polymer backbone.

Preferably, the unsaturated hydrophilic monomer component in Formula III or IV is acrylic acid. The preferred oxyethylated monomer component is the ethylene oxide adduct of allyl alcohol, having a molecular weight of about 700, and $R_4$ is an oxyethylene group represented by $CH_2$—$CH_2$—O.

A-preferred hydrophilic copolymer results from the polymerization of the acrylic acid monomer with the ethylene oxide adduct of allyl alcohol, i.e., copolymer of Formula III, where $R_1$=H, $R_2$=COOM, where M is sodium, $R_3$=$CH_2$—O, $R_4$ is —$CH_2$—$CH_2$—O, y=0, and a is about 15.

A detailed description of these polymers useful in the practice of the present invention and their preparation is provided in U.S. Pat. No. 5,595,968 and U.S. Pat. No. 5,618,782 assigned to BASF, and both incorporated by reference herein. The co-polymers of the present invention are used at a level of 0.1 to 10% by weight in a detergent composition, preferably at a level of 0.1 to 8% by weight; most preferably 1 to 6% by weight.

The following Examples further describe and demonstrate the present invention. The Examples are given solely for the purpose of illustration, and are not to be construed as limitations of the present invention.

The powdered machine dishwashing detergents of the present invention are prepared according to procedures known to those skilled in the art. Basically, the detergent composition is prepared according to methods known to those skilled in the art.

The procedure described in U.S. Pat. No. 5,423,997 specifically describes the detergent making process, useful in making compositions of the present invention, and is incorporated by reference herein.

TESTING OF THE COMPOSITIONS OF THE PRESENT INVENTION

The compositions described in Examples 1, 2, 3, and 4 were evaluated using the following test method:

Five glasses were evaluated after three-wash-rinse cycles, in a Gibson Model SP24 dishwasher, using 200 ppm hardness water. Cycle 1: 20 grams detergent in the prewash, 25 grams fat soil in prewash, 20 grams detergent in main wash; Cycle 2: Repeat Cycle 1, add 12 grams powdered milk to main wash, Cycle 3: repeat Cycle 1, add 15 grams raw egg to main wash.

The fat soil test sample is prepared by blending 72% margarine, 18% powdered milk, 5% lard, and 5% rendered beef tallow.

Example 1 contains no polymer, Example 2 contains an 8000 MW polymer of acrylic acid and Examples 3 & 4 contain co-polymers according to the present invention.

EXAMPLE 1

0% polymer
4% nonionic surfactant (INDUSTROL® DW5)
10% sodium carbonate
25% sodium metasilicate pentahydrate
1.5% chlorinated isocyanaurate
59.5% sodium sulfate

EXAMPLE 2

2% 8000 molecular weight polymer of acrylic acid
4% nonionic surfactant (INDUSTROL® DW5)
10% sodium carbonate
25% sodium metasilicate pentahydrate
1.5% chlorinated isocyanaurate
57.5% sodium sulfate

EXAMPLE 3

2% of a co-polymer, of the present invention, according to Formula I, prepared by copolymerizing acrylic acid and a propylene oxide and ethylene oxide adduct of allyl alcohol.
4% nonionic surfactant (INDUSTROL® DW5)
10% sodium carbonate 25% sodium metasilicate pentahydrate 1.5% chlorinated isocyanurate 57.5% sodium sulfate

EXAMPLE 4

2% of a co-polymer, of the present invention, according to Formula III, prepared by polymerizing acrylic acid and an ethylene oxide adduct of allyl alcohol.

4% nonionic surfactant (INDUSTROL® DW5)

10% sodium carbonate

25% sodium metasilicate pentahydrate 1.5% chlorinated isocyanurate 57.5% sodium sulfate

Preparation of Alkylene Oxide Adduct of Allyl Alcohol (I)

To a suitable reaction vessel was added a homogenous mixture of 396.2 grams allyl alcohol and 44.1 grams potassium t-butoxide. The vessel was sealed, purged with nitrogen and pressurized to 90 psig. The pressure was relieved to 2 psig and the temperature of the vessel adjusted to 80° C. The first 125 grams of propylene oxide was added over a 1 hour. The temperature was maintained between 75–85° C. and the pressure was maintained at <90 psig. The next 200 grams of propylene oxide was added over 1 hour at 75–85° C. and <90 psig pressure. The next 400 grams of propylene oxide was added over 1 hour at 100–110° C. and <90 psig pressure. The remaining 4551.2 grams of propylene oxide was added at 500 grams per hour and at 120–130° C. and <90 psig pressure. After all of the propylene oxide was added, the mixture was reacted at 125° C. for 2 hours and the vessel was vented to 0 psig. After removal of volatiles under vacuum, and cooling 50° C., the sample was discharged into an intermediate holding tank for analysis.

To a suitable reaction vessel was added 2696.8 grams of the allyl alcohol propylene oxide intermediate. The vessel was sealed and pressurized to 90 psig with nitrogen and vented to 2 psig. This was repeated two more times. The temperature was adjusted to 145° C. and the pressure was readjusted to 34 psig with nitrogen. 10788.9 grams ethylene oxide was added at 1400 grams per hour. The temperature was maintained at 140–150° C. and the pressure was maintained at <90 psig. If the pressure rose above 85 psig, the ethylene oxide addition was slowed. If this failed to lower the pressure, the addition was halted and allowed to react at 145° C. for 30 minutes. The vessel was slowly vented to 0 psig and repressurized to 34 psig with nitrogen. The addition was continued at 140–150° C. and <90 psig pressure. After all of the ethylene oxide was added, the material was held at 145° C. for 1 hour. After cooling to 90° C., 14.3 grams of 85% phosphoric acid was added. After mixing for 30 minutes, the temperature was lowered to 100° C. and volatiles removed under vacuum. The batch was cooled at 70° C. and discharged into a holding tank. The product was found to have a number average molecular weight of 4091 by phthalic anhydride esterification in pyridine.

Polymerization of I with Acrylic Acid

To a two liter, four-necked flask equipped with a mechanical stirrer, reflux condenser, thermometer, and outlet for feed lines, were added 301 grams of distilled water and 2.6 grams of 70% phosphorous acid. After heating to 95° C., a monomer blend of 555.4 grams of glacial acrylic acid and 61.7 grams of an allyl alcohol initiated propoxylate ethoxylate (I) (molecular weight @ 3500), a redox initiator system consisting of 132 grams of a 38% sodium bisulfite solution and 155.4 grams of a 10.9% sodium persulfate solution, are fed into the flask linearly and separately while maintaining the temperature at 95±3° C. The sodium bisulfite solution and monomer blend feeds are added over 4 hours while the sodium persulfate solution is added over 4,25 hours. The three feeds are added via TEFLON® ⅛ inch tubing lines connected to rotating piston pumps. Appropriately sized glass reservoirs attached to the pumps hold the monomer blend and initiator feeds on balances accurate to 0.1 gram to precisely maintain feed rates. When the additions are complete, the system is cooled to 80° C. and 25.3 grams of 2.4% 2,2'-azobis (N,N'-dimethyleneisobutyramidine) dihydrochloride solution is added over 0.5 hours as a post-polymerizer. When addition is complete the system is reacted for 2 hours. After reaction, the system is cooled to 60° C. and the solution pH is adjusted to about 7 with the addition of 658 grams of 50% sodium hydroxide solution. The resultant pH 7 polymer solution has an approximate solids content of 40%.

Table 1 serves to illustrate the superior benefits of the present invention over the prior art. The spotting and filming ratings in Table 1 are on a scale between 1.0 and 5.0, where 1.0 is indicative of no spotting or filming and 5.0 is indicative of very heavy spotting and filming, respectively. Clearly spotting and filming is reduced when the co-polymers (Examples 3 & 4) of the present invention are used.

TABLE 1

| EXAMPLE | SPOTTING | FILMING |
|---|---|---|
| 1 | 2.0 | 4.5 |
| 2 | 1.2 | 3.3 |
| 3 | 1.2 | 2.7 |
| 4 | 1.4 | 2.3 |

Clearly, the compositions containing certain copolymers of the alkylene oxide adducts of allyl alcohol and acrylic acid are surprisingly effective at minimizing the spotting-and-filming of glassware.

What is claimed is:

1. A powdered machine dishwashing composition useful for reducing the spotting and filming of dishware consisting essentially of:

(a) 0–15% nonionic surfactant;

(b) 2–40% non-phosphate builder;

(c) 0–20% non-chlorine bleach;

(d) 0–7% bleach activators;

(e) 0.5–8% enzymes;

(f) 0.1–10% copolymer of Formula I, II, III or IV or mixtures thereof, wherein Formula I is:

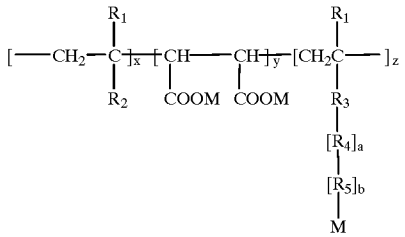

and Formula II is:

-continued

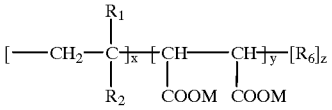

wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$ = H or $CH_3$;

$R_2$ = COOM, $OCH_3$, $SO_3M$, O—CO—$CH_3$, —CO—$NH_2$;

$R_3$ = $CH_2$—O—, $CH_2$—N—, COO—, —O—, $CH_2$—O—$CH_2$—CH(O)—O—, CO—NH—;

$R_4$ = $C_3$ to $C_4$ alkyleneoxy group;

$R_5$ = —$CH_2$—$CH_2$—O;

$R_6$ = 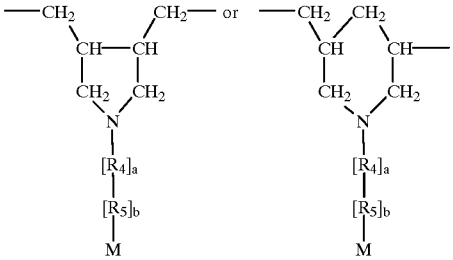

and Formula III is:

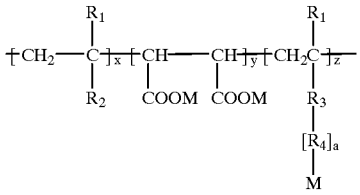

and Formula IV is:

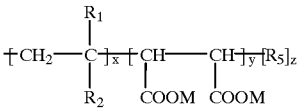

wherein x, y and z are integers, (x+y):z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$ = H or $CH_3$;

$R_2$ = COOM, $OCH_3$, $SO_3M$, O—CO—$CH_3$, —CO—$NH_2$, $R_3$ = $CH_2$—O—, $CH_2$—N—, COO—, —O—, $CH_2$—O—$CH_2$—CH(O)—O—, CO—NH—;

$R_4$ = —$CH_2$—$CH_2$—O

-continued where $R_5$ = 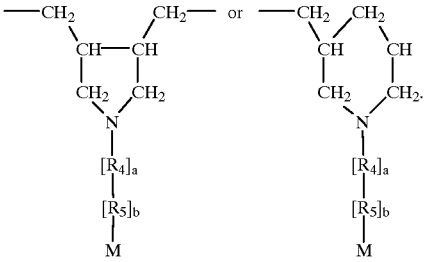

2. A dishwashing composition according to claim 1, wherein in Formula I, $R_1$=H; $R_2$=COOM; M=sodium; $R_3$=$CH_2$—O; y=O; and a:b is about 1:5.

3. A dishwashing composition according to claim 1, wherein in Formula III, $R_1$=H; $R_2$=COOM; M=sodium; $R_3$=$CH_2$—O; $R_4$ is $CH_2$—$CH_2$—O; y=0; and a is about 15.

4. A dishwashing composition according to claim 1, consisting essentially of:

(a) 1–6% nonionic surfactant;

(b) 5–30% non-phosphate builder;

(c) 6–10% non-chlorine bleach;

(d) 3–5% bleach activators;

(e) 0.5–8% enzymes; and (f) 1–6% copolymer of Formula I, II, III or IV.

5. A dishwashing composition according to claim 1, consisting essentially of:

(a) 1–6% nonionic surfactant;

(b) 5–30% non-phosphate builder;

(c) 6–10% non-chlorine bleach;

(d) 3–5% bleach activators;

(e) 0.5–8% enzymes; and (f) 1–6% copolymer of Formula I, wherein $R_1$=H; $R_2$=COOM; M=sodium; $R_3$=$CH_2$—O; y=0; and a:b is about 1:5.

6. A dishwashing composition according to claim 1, consisting essentially of:

(a) 1–6% nonionic surfactant;

(b) 5–30% non-phosphate builder;

(c) 6–10% non-chlorine bleach;

(d) 3–5% bleach activators;

(e) 0.5–8% enzymes; and (f) 1–6% copolymer of Formula I, wherein $R_1$=H; $R_2$=COOM; M=sodium; $R_3$=$CH_2$—O; $R_4$=$CH_2$—$CH_2$—O; y=0; and a is about 15.

7. A method of reducing spotting and filming of dishware comprising contacting said dishware with a wash solution containing a composition according to claim 2.

8. A method of reducing spotting and filming of dishware comprising contacting said dishware with a wash solution containing a composition according to claim 3.

9. A method of reducing the spotting and filming of dishware comprising contacting said dishware with a wash solution containing a composition according to claim 4.

10. A method of reducing the spotting and filming of dishware comprising contacting said dishware with a wash solution containing a composition according to claim 5.

11. A method of reducing the spotting and filming of dishware comprising contacting said dishware with a wash solution containing a composition according to claim 6.

12. A powdered machine dishwashing composition useful for reducing the spotting and filming of dishware consisting essentially of:

(a) 0–15% nonionic surfactant
(b) 2–40% non-phosphate builder
(c) 1–10% chlorine bleach
(d) 0.1–10% copolymer of Formula I, II, III or IV or mixtures thereof, wherein Formula I is:

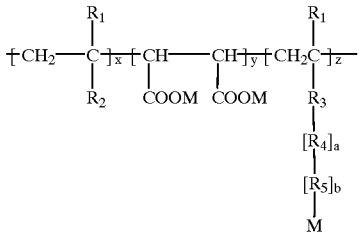

and Formula II is:

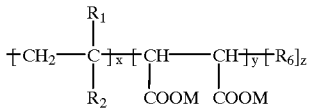

wherein x, y, z, a, and b are integers, (x+y):z is from about 5:1 to about 1000:1, and y can be any value ranging from zero up to the value of x; M is an alkali metal or hydrogen; a:b is from about 1:4 to about 1:99;

$R_1$ = H or $CH_3$;

$R_2$ = COOM, $OCH_3$, $SO_3M$, O—CO—$CH_3$, —CO—$NH_2$;

$R_3$ = $CH_2$—O—, $CH_2$—N—, COO—, —O—, $CH_2$—O—$CH_2$—CH(O)—O—, CO—NH—;

$R_4$ = $C_3$ to $C_4$ alkyleneoxy group;

$R_5$ = —$CH_2$—$CH_2$—O;

$R_6$ =

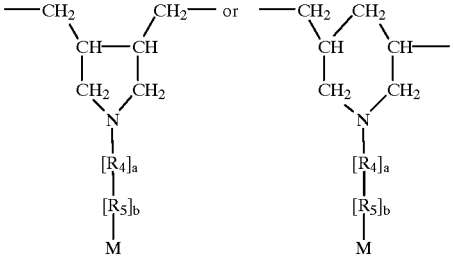

and Formula III is:

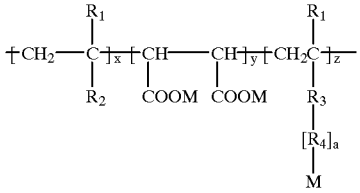

and Formula IV is:

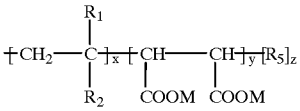

wherein x, y and z are integers, (x+y):z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$ = H or $CH_3$;

$R_2$ = COOM, $OCH_3$, $SO_3M$, O—CO—$CH_3$, —CO—$NH_2$, $R_3$ = $CH_2$—O—, $CH_2$—N—, COO—, —O—, $CH_2$—O—$CH_2$—CH(O)—O—, CO—NH—;

$R_4$ = —$CH_2$—$CH_2$—O;

where $R_5$ =

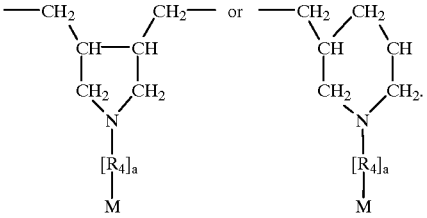

13. A dishwashing composition according to claim 12, wherein in Formula I, $R_1$=H; $R_2$—COOM; M=sodium; $R_3$=$CH_2$—O; y=0; and a:b is about 1:5.

14. A dishwashing composition according to claim 12, wherein in Formula III, $R_1$=H; $R_2$—COOM; M=sodium; $R_3$=$CH_2$—O; $R_4$ is $CH_2$—$CH_2$—O; y=0; and a is about 15.

15. A dishwashing composition according to claim 12, consisting essentially of:

(a) 1–6% nonionic surfactant;
(b) 5–30% non-phosphate builder;
(c) 0.5–3% chlorine bleach compounds; and
(d) 1–6% copolymer of Formula I, II, III or IV.

16. A dishwashing composition according to claim 13, consisting essentially of:

(a) 1–6% nonionic surfactant;
(b) 5–30% non-phosphate builder;
(c) 0.5–3% chlorine bleach compounds; and
(d) 1–6% copolymer of Formula I, wherein $R_1$=H $R_2$=COOM; M=sodium; $R_3$=$CH_2$—O; y=0; and a:b is about 1:5.

17. A dishwashing composition according to claim 14, consisting essentially of:

(a) 1–6% nonionic surfactant;
(b) 5–30% non-phosphate builder;
(c) 0.5–3% chlorine bleach compounds; and
(d) 1–6% copolymer of Formula I, wherein $R_1$=H $R_2$=COOM; M=sodium; $R_3$=$CH_2$—O; y=0; and a:b is about 1:5.

18. A method of reducing spotting and filming of dishware comprising contacting said dishware with a wash solution containing a composition according to claim 12.

19. A method of reducing spotting and filming of dishware comprising contacting said dishware with a wash solution containing a composition according to claim 13.

20. A method of reducing spotting and filming of dishware comprising contacting said dishware with a wash solution containing a composition according to claim 14.

21. A method of reducing spotting and filming of dishware comprising contacting said dishware with a wash solution containing a composition essentially of:

(a) 0–15% nonionic surfactant;
(b) 2–40% non-phosphate builder;

(c) 0–20% non-chlorine bleach;

(d) 0–7% bleach activators;

(e) 0.5–8% enzymes; and (f) 0.1–10% copolymer of Formula I, II, III or IV or mixtures thereof, wherein Formula I is:

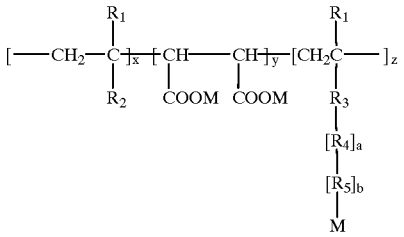

and Formula II is:

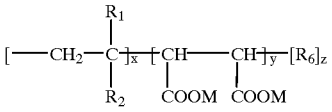

wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$ = H or $CH_3$;

$R_2$ = COOM, $OCH_3$, $SO_3M$, O—CO—$CH_3$, —CO—$NH_2$;

$R_3$ = $CH_2$—O—$CH_2$—N—, COO—, —O—, $CH_2$—O—$CH_2$—CH(O)—O—, CO—NH—

$R_4$ = $C_3$ to $C_4$ alkylemenoxy group;

$R_5$ = —$CH_2$—$CH_2$—O;

$R_6$ = 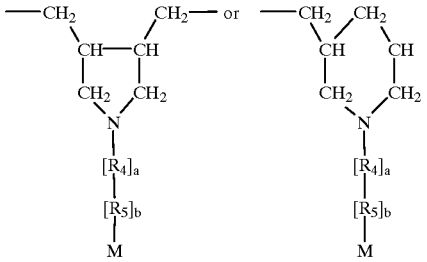

-continued and Formula III is:

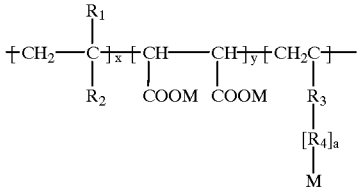

and Formula IV is:

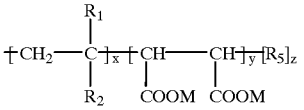

wherein x, y and z are integers, (x+y):z is from about 5:1 to 1000:1, and you can be any value ranging from zero up to the value of x; M is an alkali metal or hydrogen; a is an integer from about 3 to about 680; and the hydrophilic and oxyethylated monomers may be in random order;

$R_1$ = H or $CH_3$;

$R_2$ = COOM, $OCH_3$, $SO_3M$, O—CO—$CH_3$, CO—$NH_2$;

$R_3$ = $CH_2$—O—, $CH_2$—N—, COO—, —O—, $CH_2$—O—$CH_2$—CH(O)—O—, CO—NH—;

$R_4$ = $CH_2$—$CH_2$—O;

$R_5$ = 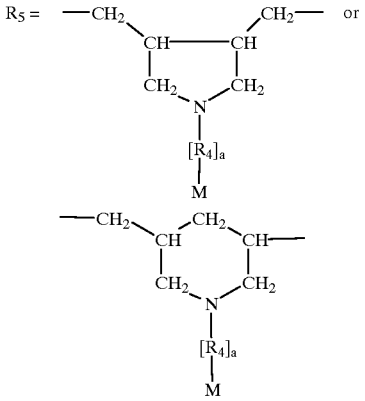

* * * * *